US011548744B2

(12) United States Patent
Zheng

(10) Patent No.: US 11,548,744 B2
(45) Date of Patent: Jan. 10, 2023

(54) IMAGE FORMING APPARATUS

(71) Applicant: Brother Kogyo Kabushiki Kaisha, Nagoya (JP)

(72) Inventor: Jie Zheng, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 330 days.

(21) Appl. No.: 16/697,577

(22) Filed: Nov. 27, 2019

(65) Prior Publication Data

US 2020/0172356 A1 Jun. 4, 2020

(30) Foreign Application Priority Data

Nov. 29, 2018 (JP) ..... JP2018-223905

(51) Int. Cl.
*B65H 1/04* (2006.01)
*B65H 1/26* (2006.01)
*G03G 15/00* (2006.01)

(52) U.S. Cl.
CPC ..... *B65H 1/266* (2013.01); *B65H 1/04* (2013.01); *G03G 15/6502* (2013.01); *B65H 2405/31* (2013.01); *B65H 2511/10* (2013.01); *B65H 2511/20* (2013.01)

(58) Field of Classification Search
CPC ..... B65H 1/266; B65H 1/04; B65H 2511/10; B65H 2511/20; B65H 1/00; B65H 2405/31; G03G 15/6502
See application file for complete search history.

(56) References Cited

U.S. PATENT DOCUMENTS 6,486,680 B1 * 11/2002 Mull ..... G01B 7/048 324/688
2004/0051234 A1 * 3/2004 Lien ..... B65H 1/04 271/171
2015/0329300 A1 11/2015 Hayayumi
(Continued)

FOREIGN PATENT DOCUMENTS

JP 2008-133083 A 6/2008
JP 5825925 * 10/2015
(Continued)

OTHER PUBLICATIONS

Japanese Notice of Reasons for Refusal (with English translation), Japanese Application No. 2018-223905, dated Oct. 25, 2022 (3 pages).

*Primary Examiner* — Thomas A Morrison
(74) *Attorney, Agent, or Firm* — Burr & Brown, PLLC

(57) ABSTRACT

An image forming apparatus includes a main body, a sheet cassette, and a controller. The main body includes a first electrode, a second electrode, and a capacitance detector configured to output a signal indicating a value corresponding to a quantity of electricity stored in the first electrode and the second electrode. The sheet cassette includes a sheet guide, and a conductor disposed in an upper portion of the sheet guide. In a state in which the sheet cassette is at an installation position defined in the main body, the first electrode and the second electrode face the conductor in an up-down direction and are at different positions in a moving direction in which the sheet guide is movable. The controller is configured to detect a position of the sheet guide from the value of the signal outputted from the capacitance detector.

13 Claims, 7 Drawing Sheets

(56) References Cited

U.S. PATENT DOCUMENTS

| | | | | |
|---|---|---|---|---|
| 2017/0152119 | A1 | 6/2017 | Kubota et al. | |
| 2017/0341889 | A1 | 11/2017 | Kikuta | |
| 2020/0172362 | A1* | 6/2020 | Ono | B65H 1/266 |

FOREIGN PATENT DOCUMENTS

| | | | |
|---|---|---|---|
| JP | 2015-218019 | A | 12/2015 |
| JP | 2017-100828 | A | 6/2017 |
| JP | 2017-214186 | A | 12/2017 |

* cited by examiner

1

IMAGE FORMING APPARATUS

CROSS-REFERENCE TO RELATED APPLICATION

This application claims priority from Japanese Patent Application No. 2018-223905 filed on Nov. 29, 2018, the content of which is incorporated herein by reference in its entirety.

TECHNICAL FIELD

Aspects of the disclosure relate to an image forming apparatus, for example, a printer.

BACKGROUND

A known image forming apparatus forms an image on a sheet supplied from a sheet cassette into a main body. The sheet cassette is configured to accommodate different sizes of sheets and includes a sheet guide to be moved by a user. The sheet guide is positioned in alignment with an end of a sheet and thus the sheet is positioned relative to the sheet cassette with respect to a position of the sheet guide.

A variety of devices have been developed for detecting a size of a sheet accommodated in the sheet cassette in such an image forming apparatus. One example is a combination of a detector and a sensor. The detector is disposed at an outer surface of the sheet cassette, and a sensor is disposed at the main body to which the sheet cassette is attached. The movement of the sheet guide is mechanically transmitted to the detector, and the sensor detects a state of the detector to determine a size of sheet.

SUMMARY

The above structure, however, uses a mechanism for transmitting the movement of the sheet guide to the detector that is exposed at the outer surface of the sheet cassette. The detector may be damaged by user. The structure uses detectors or sensors in agreement with each size of sheets, thus leading to high costs.

Aspects of the disclosure provide an image forming apparatus that detects a size of sheets held in a sheet cassette with an inexpensive and failure-resistant structure.

According to one or more aspects of the disclosure, an image forming apparatus includes a main body, an image forming unit disposed in the main body, a sheet cassette attachable to the main body and configured to support a sheet to be supplied to the image forming unit, and a controller disposed in the main body. The main body includes a first electrode, a second electrode, and a capacitance detector configured to output a signal indicating a value corresponding to a quantity of electricity stored in the first electrode and the second electrode. The sheet cassette includes a sheet guide movable to position the sheet relative to the sheet cassette, and a conductor disposed in an upper portion of the sheet guide. The main body defines an installation position in which sheets are feedable from the sheet cassette toward the image forming unit. The first electrode and the second electrode are disposed such that, in a state in which the sheet cassette is at the installation position defined in the main body, the first electrode and the second electrode face the conductor in an up-down direction and are at different positions in a moving direction in which the sheet guide is movable. The moving direction is orthogonal to the up-down direction. The controller is configured to detect a position of the sheet guide from the value of the signal outputted from the capacitance detector.

According to this structure, when a position of the sheet guide changes, relative positions of the first electrode, the second electrode, and the conductor change, and thus a value of a signal outputted from the capacitance detector changes. The controller detects the position of the sheet guide from the value. The sheet guide is positioned in alignment with an end of a sheet supported on the sheet cassette. The controller thus can detect a size of sheets supported on the sheet cassette from the position of the sheet guide.

The sheet cassette is devoid of a member movable in response to the movement of the sheet guide. This may eliminate a factor leading to a failure of the sheet guide caused by damage to the movable member by user's handling.

In addition, the different sizes of sheets to be supported on the sheet cassette can be detected simply by using a single sensor including the first electrode, the second electrode, and the capacitance detector.

Thus, a size of sheets supported on the sheet cassette can be detected by an inexpensive and failure-resistant structure.

DETAILED DESCRIPTION

An illustrative embodiment will be described with reference to the accompany drawings.

Overall Structure

Figure 1:
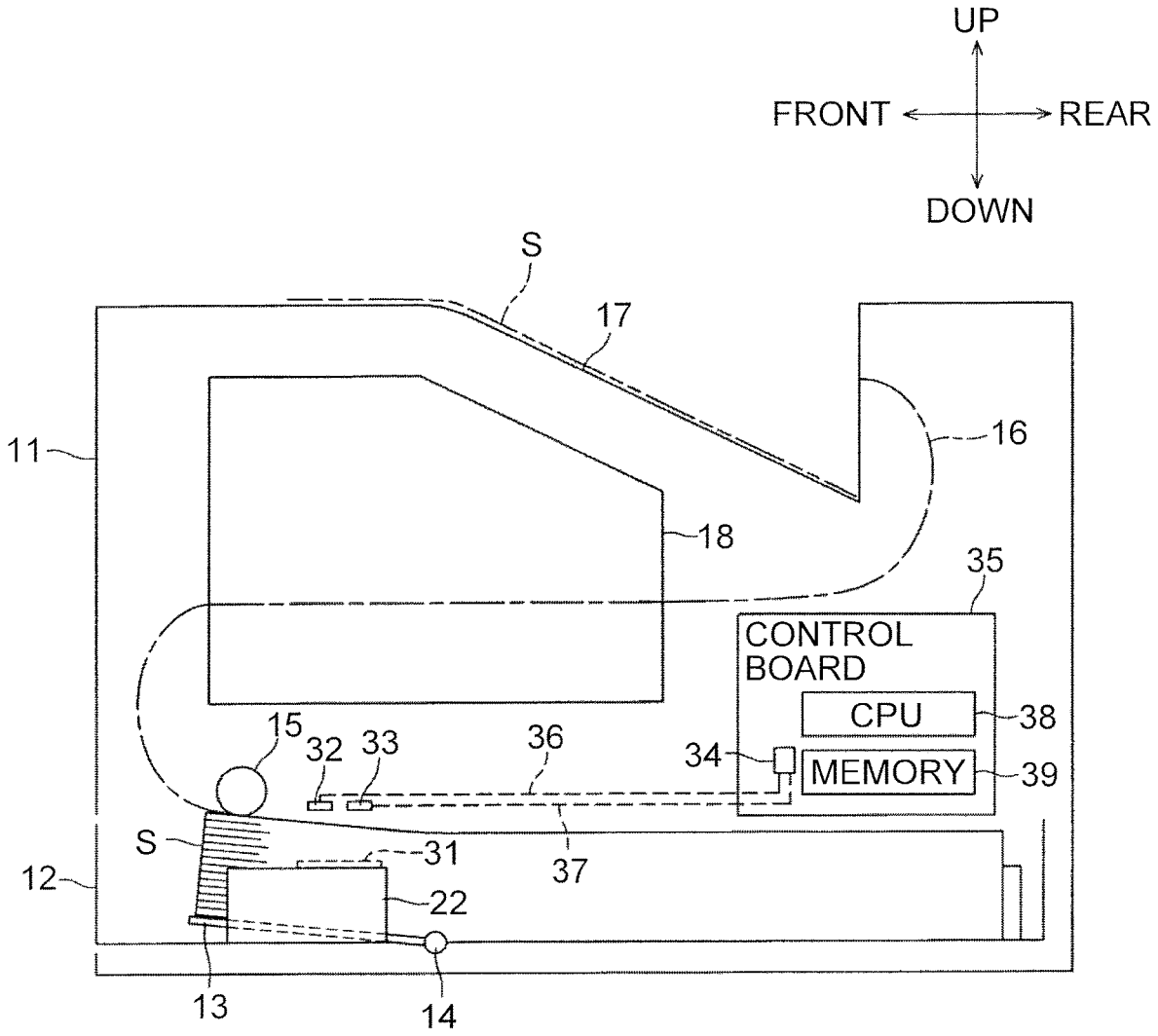
FIG. 1 is a cross sectional view schematically illustrating an image forming apparatus according to an illustrative embodiment of the disclosure.

As illustrated in FIG. 1, an image forming apparatus 1 includes a casing 11 as an example of a main body. The casing 11 defines an outer appearance of the image forming apparatus 1.

A sheet cassette 12 is disposed in a bottom portion of the casing 11. The bottom portion of the casing 11 defines an installation position of the sheet cassette 12 in which sheets are feedable from the sheet cassette 12 toward an image forming unit 18. The sheet cassette 12 is inserted into the casing 11 from one side, e.g., front side, of the casing 11 toward the installation position. The sheet cassette 12 at the installation position is removable from the casing 11 by being pulled to the one side of the casing 11.

In the following description, one side of the casing 11, that is, a side from which the sheet cassette 12 is removed from the installation position (a left side of FIG. 1) may be referred to as a front side, and its opposite side will be referred to as a rear side. Left and right sides of the image forming apparatus 1 may be identified as viewed from a user in front of the image forming apparatus 1. A direction orthogonal to a front-rear direction and a left-right direction may be an up-down direction, and up and down or upper and lower sides of the image forming apparatus 1 may be identified in conjunction with an orientation in which the image forming apparatus 1 is placed in a horizontal plane.

The sheet cassette 12 is configured to hold a stack of sheets S therein. The sheet cassette 12 includes a sheet supporting plate 13 that supports one or more sheets S from below. The sheet supporting plate 13 includes a shaft 14. The shaft 14 is supported by the sheet cassette 12 rotatably. The sheet supporting plate 13 is pivotable about the shaft 14 between an up position in which a front end portion of the sheet supporting plate 13 is raised from a bottom surface of the sheet cassette 12 and a down position in which the sheet supporting plate 13 extends along the bottom surface of the sheet cassette 12. As the sheet supporting plate 13 pivots, leading ends of the sheets S supported on the sheet supporting plate 13 moves up and down.

A feed roller 15 is disposed in the casing 11. The feed roller 15 is disposed at a front end portion of the casing 11 and above the installation position. When the sheet cassette 12 is installed at the installation position and the sheet supporting plate 13 is in the down position, no sheets S supported on the sheet supporting plate 13 contact the feed roller 15. When the sheet supporting plate 13 moves from the down position to the up position, a front end portion of an uppermost sheet S contacts the feed roller 15 from below.

In this state, upon rotation of the feed roller 15, the uppermost sheet S is fed from the sheet cassette 12 toward a conveyance path 16 defined in the casing 11. The casing 11 has a recessed portion at its upper surface. The recessed portion has a bottom surface inclined down to the rear, serving as a sheet discharge tray 17. The conveyance path 16 is curved upward to the front from the feed roller 15, extends straightly to the rear, is curved upward to the rear, and then is open at a rear end of the sheet discharge tray 17. The image forming unit 18 to form an image on a sheet S is disposed in the casing 11. The conveyance path 16 passes through the image forming unit 18. A sheet S fed from the sheet cassette 12 is conveyed along the conveyance path 16 through the image forming unit 18 toward the sheet discharge tray 17. As the sheet S passes through the image forming unit 18, an image is formed on the sheet S. The sheet S having the image thereon is discharged from the conveyance path 16 to the sheet discharge tray 17. A subsequent sheet S is discharged and stacked onto the discharged sheet S remaining on the sheet discharge tray 17.

The image forming unit 18 may form an image based on electrography or ink jet printing.

Sheet Guides

Figure 2:
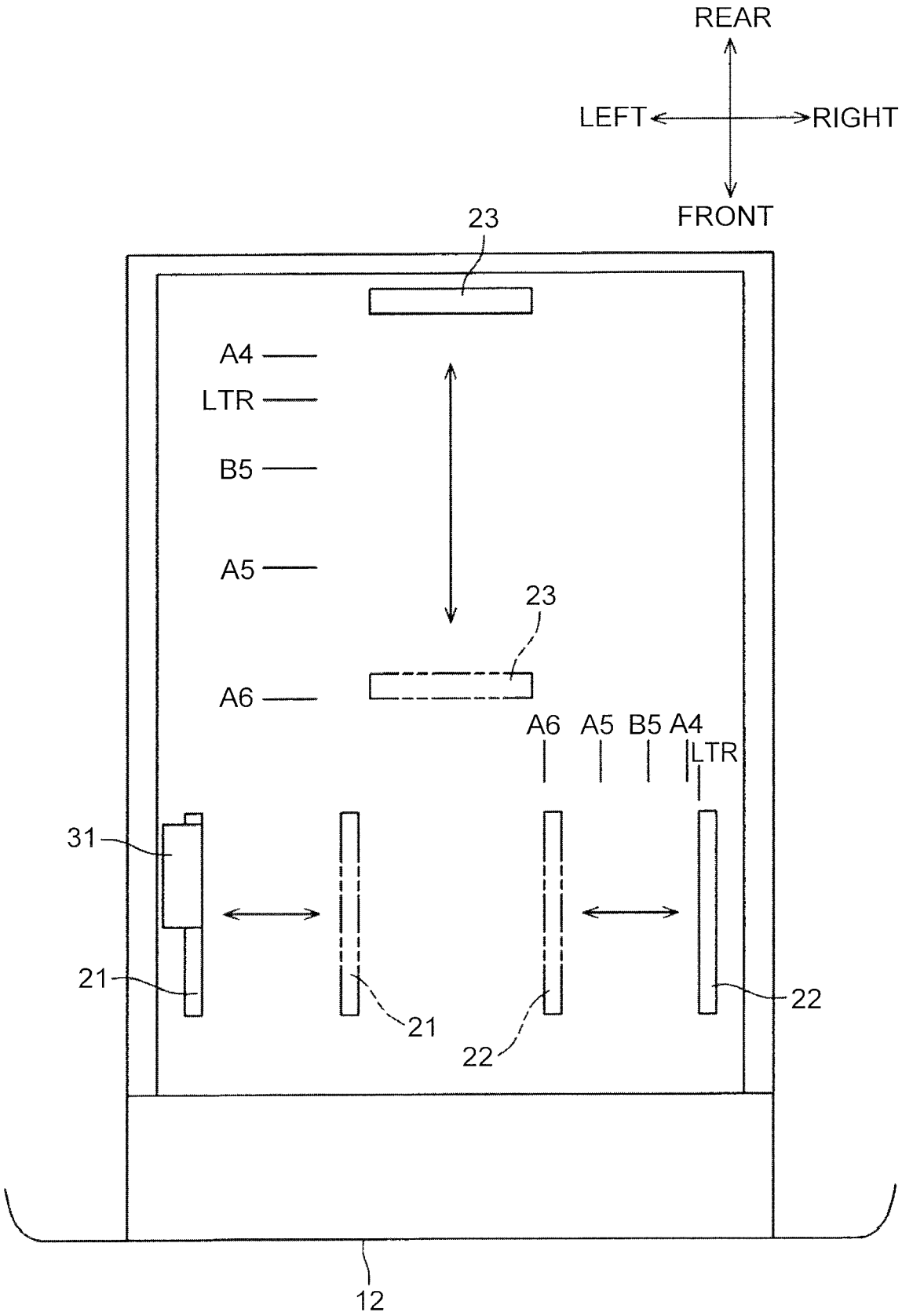
FIG. 2 is a plan view schematically illustrating a sheet cassette used in the image forming apparatus.

As illustrated in FIG. 2, the sheet cassette 12 includes a pair of side guides 21, 22 and a rear-end guide 23, which are an example of a sheet guide.

The side guides 21, 22 are disposed in a front portion of the sheet cassette 12 relative to a center of the sheet cassette 12 in the front-rear direction and opposite to each other in the left-right direction. The side guides 21, 22 have inner surfaces opposite to each other in the left-right direction. The inner surfaces are flat and extend in the front-rear direction and the up-down direction. The side guides 21, 22 are movable close to or away from each other by the same amount relative to a center therebetween in the left-right direction.

The spacing between the side guides 21, 22 is adjusted in accordance with a width, in the left-right direction, of a sheet S supported on the sheet supporting plate 13 of the sheet cassette 12. The side guides 21, 22 are positioned in accordance with a size of a sheet S. For a letter-sized sheet S, for example, the side guides 21, 22 are positioned such that the inner surface of the side guide 22 is aligned with a "LTR (letter)" mark located furthest to the right in the left-right direction (hereinafter, referred to as "positioned at a letter-size position"). For an A4-sized sheet S, the side guides 21, 22 are positioned such that the inner surface of the side guide 22 is aligned with an "A4" mark located immediately on the left side of the "LTR" mark (hereinafter, referred to as "positioned at an A4-size position"). For a B5-sized sheet S, the side guides 21, 22 are positioned such that the inner surface of the side guide 22 is aligned with a "B5" mark located immediately on the left side of the "A4" mark in the left-right direction (hereinafter, referred to as "positioned at a B5-size position"). For an A5-sized sheet S, the side guides 21, 22 are positioned such that the inner surface of the side guide 22 is aligned with an "A5" mark located immediately on the left side of the "B5" mark in the left-right direction (hereinafter, referred to as "positioned at an A5-size position"). For an A6-sized sheet S, the side guides 21, 22 are positioned such that the inner surface of the side guide 22 is aligned with a "A6" mark located immediately on the left side of the "A5" mark in the left-right direction (hereinafter, referred to as "positioned at an A6-size position").

After one or more sheets S are placed between the side guides 21, 22, the side guides 21, 22 are moved until their inner surfaces contact left and right edges of the sheets S, thereby centering the sheets S in the left-right direction.

The rear-end guide 23 is disposed in a rear end portion of the sheet cassette 12 relative to the center of the sheet cassette 12 in the front-rear direction and in the middle of the rear end portion in the left-right direction. The rear-end guide 23 has a front surface that is flat and extends in the left-right direction and the up-down direction. The rear-end guide 23 is movable in the front-rear direction.

The position of the rear-end guide 23 is adjusted in accordance with a dimension, in the front-rear direction, of a sheet S supported on the sheet supporting plate 13 of the sheet cassette 12. The rear-end guide 23 is positioned in accordance with a size of a sheet S. For an A4-sized sheet S, for example, the rear-end guide 23 is positioned at an "A4" mark located furthest to the rear in the front-rear direction. For a letter-sized sheet S, the rear-end guide 23 is positioned at a "LTR (letter)" mark located immediately on the front side of the "A4" mark. For a B5-sized sheet S, the rear-end guide 23 is positioned at a "B5" mark located immediately on the front side of the "LTR" mark. For an A5-sized sheet S, the rear-end guide 23 is positioned at an "A5" mark located immediately on the front side of the "B5" mark. For an A6-sized sheet S, the rear-end guide 23 is positioned at an "A6" mark located immediately on the front side of the "A5" mark.

The front surface of the rear-end guide 23 contacts the rear edges of the sheets S, thereby positioning the sheets S in the front-rear direction. When the sheet supporting plate 13 supporting the sheets S moves to the up position and the front ends of the sheets S are raised, the sheets S are held by the rear-side guide 23 without coming apart to the rear.

Principal Structure

A rectangular conductor 31 is attached to an upper surface of a rear end portion of the left side guide 21. The conductor 31 may be a metal plate such as an iron plate. The conductor 31 has its right end extending along an inner end (i.e., a right end) of the upper surface of the left side guide 21 in the left-right direction. The conductor 31 extends beyond the side guide 21 to the left.

As illustrated in FIG. 1, a first electrode 32, a second electrode 33, a capacitance detector 34, and a control board 35 are disposed in the casing 11.

The first electrode 32 and the second electrode 33 are disposed on a member of the casing 11 located above a compartment for the sheet cassette 12 in the casing 11, and arranged in the front-rear direction with a space left therebetween.

The capacitance detector 34 is contained on the control board 35. The capacitance detector 34 is electrically connected to the first electrode 32 via a harness 36 and the second electrode 33 via a harness 37. The capacitance detector 34 outputs a signal corresponding to a quantity of electricity stored in the first electrode 32 and the second electrode 33, more specifically, a signal indicating a capacitance value C of a synthetic pseudocapacitor in which a pseudocapacitor having the first electrode 32 as one electrode and a pseudocapacitor having the second electrode 33 as one electrode are connected in series.

The control board 35 contains a CPU 38, as an example of a controller, thereon. The CPU 38 detects a capacitance value C from a signal outputted from the capacitance detector 34. In addition to the capacitance detector 34 and the CPU 38, the control board 35 contains thereon electronic parts including nonvolatile and volatile memory chips, which are required for controlling each part of the image forming apparatus 1. The CPU 38 may be integrated in an ASIC (Application Specific Integrated Circuit) together with nonvolatile and volatile memory chips, and the ASIC may be contained on the control board 35.

Figure 3:
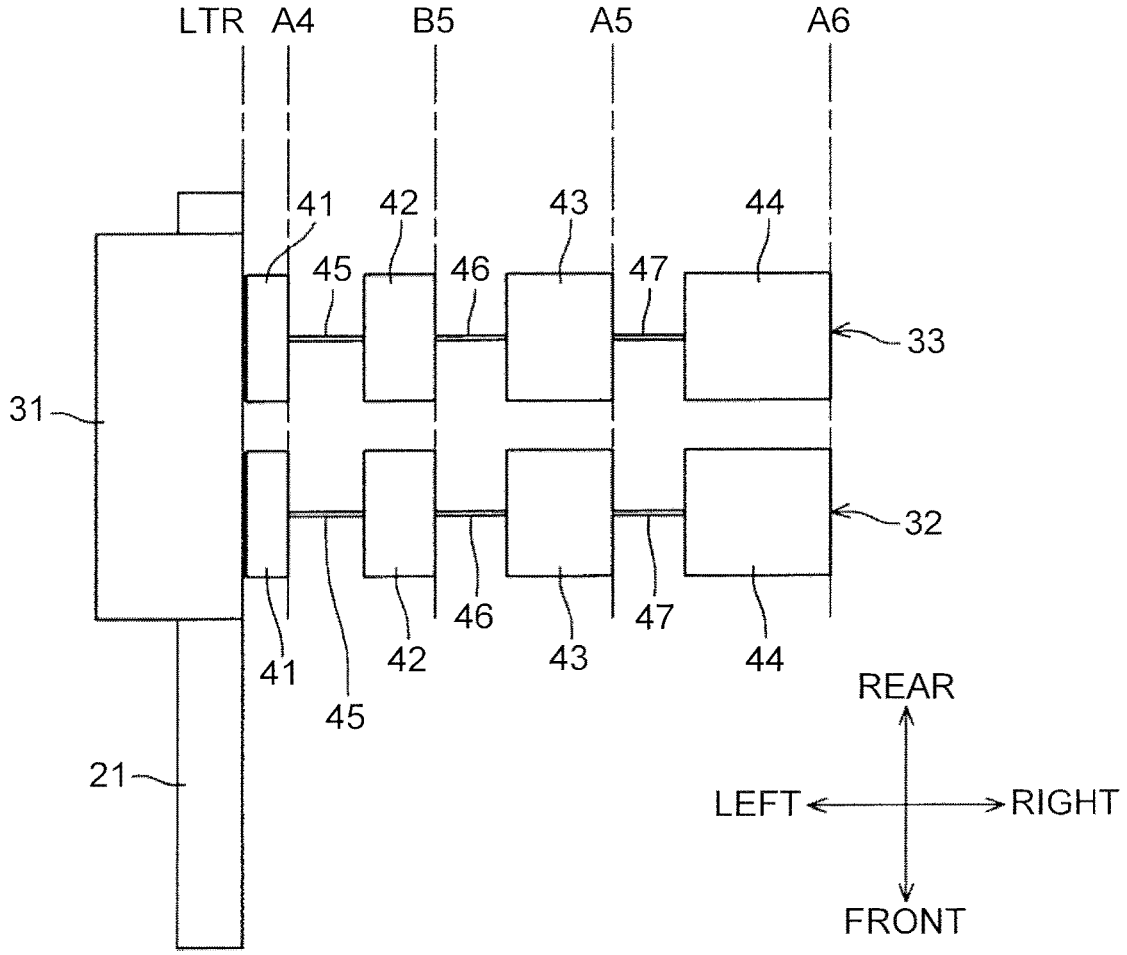
FIG. 3 is a plan view of a first electrode and a second electrode.

As illustrated in FIG. 3, the first electrode 32 includes an A4-size detection electrode portion 41, a B5-size detection electrode portion 42, an A5-size detection electrode portion 43, and an A6 size-detection electrode portion 44, which are all an example of a sheet-size detection electrode portion. The A4 size-detection electrode portion 41, the B5-size detection electrode portion 42, the A5-size detection electrode portion 43, and the A6-size detection electrode portion 44 are rectangular and have the same dimension in the front-rear direction. The A4-size detection electrode portion 41, the B5-size detection electrode portion 42, the A5-size detection electrode portion 43, and the A6-size detection electrode portion 44 have respective dimensions, in the left-right direction, which are different from one another by a fixed value. That is, the A4-size detection electrode portion 41 has the minimum dimension in the left-right direction. The minimum dimension is set to less than half a dimension of a difference between a short side dimension of the letter size and a short side dimension of the A4 size. (In a case in which the side guide 21 is fixed and the side guide 22 is movable, the minimum dimension may be less than a dimension of a difference between the short side dimension of the letter size and the short side dimension of the A4 size.) The B5-size detection electrode portion 42 has a dimension in the left-right direction greater than that of the A4-size detection electrode portion 41 by the fixed value. The A5 size detection electrode portion 43 has a dimension in the left-right direction greater than that of the B5 size detection electrode portion 42 by the fixed value. The A6 size detection electrode portion 44 has the maximum dimension in the left-right direction, which is greater than the dimension of the A5 size detection electrode portion 43 by the fixed value and equal to the dimension, in the left-right direction, of the conductor 31 located in the sheet cassette 12.

The A4-size detection electrode portion 41, the B5-size detection electrode portion 42, the A5-size detection electrode portion 43, and the A6-size detection electrode portion 44 are located at the same position in the front-rear direction and aligned in the left-right direction that is a moving direction in which the side guides 21, 22 are movable. The A4-size detection electrode portion 41 is disposed such that its right end is aligned with the A4-size position. The B5 size detection electrode portion 42 is disposed such that its right end is aligned with the B5-size position. The A5 size detection electrode portion 43 is disposed such that its right end is aligned with the A5-size position. The A6 size detection electrode portion 44 is disposed such that its right end is aligned with the A6-size position.

The A4-size detection electrode portion 41 and the B5-size detection electrode portion 42 are spaced from each other and connected to each other with a connection portion 45 extending therebetween linearly in the left-right direction. The B5 size detection electrode portion 42 and the A5 size detection electrode portion 43 are spaced from each other and connected to each other with a connection portion 46 extending therebetween linearly in the left-right direction. The A5 size detection electrode portion 43 and the A6 size detection electrode portion 44 are spaced from each other and connected to each other with a connection portion 47 extending therebetween linearly in the left-right direction. The connection portions 45, 46, 47 are rectangular and each have a dimension in the front-rear direction smaller than the dimension of the A4-size detection electrode portion 41 in the left-right direction.

The second electrode 33 is identical in shape and structure to the first electrode 32. For brevity, description about the structure of the second electrode 33 is omitted and, in FIG. 3, elements of the second electrode 33 corresponding to those of the first electrode 32 are designated by similar numerals.

The first electrode 32 and the second electrode 33 are disposed, in a plan view, in an area corresponding to an area of the sheet cassette 12 in which the conductor 31 is movable as the side guides 21, 22 move. The second electrode 33 is disposed behind the first electrode 32. In the front-rear direction, a distance from a front end of the first electrode 32 to a rear end of the second electrode 33 is smaller than or equal to a dimension of the conductor 31 disposed in the sheet cassette 12.

When the side guides 21, 22 are positioned at the letter-size position, the conductor 31 does not face any of the A4-size detection electrode portions 41, the B5-size detection electrode portions 42, the A5-size detection electrode portions 43, and the A6-size detection electrode portions 44 in the up-down direction. When the side guides 21, 22 are positioned at the A4-size position, the conductor 31 faces the whole areas of the A4-size detection electrode portions 41 of the first electrode 32 and the second electrode 33 in the up-down direction. When the side guides 21, 22 are positioned at the B5-size position, the conductor 31 faces the whole areas of the B5 size detection electrode portions 42 of the first electrode 32 and the second electrode 33 in the up-down direction. When the side guides 21, 22 are positioned at the A5-size position, the conductor 31 faces the whole areas of the A5 size detection electrode portions 43 of the first electrode 32 and the second electrode 33 in the up-down direction. When the side guides 21, 22 are positioned at the A6-size position, the conductor 31 faces the whole areas of the A6 size detection electrode portions 44 of the first electrode 32 and the second electrode 33 in the up-down direction.

When the side guides 21, 22 are positioned at the B5-size position, the conductor 31 does not face the A4-size detection electrode portions 41 in the up-down direction. When the side guides 21, 22 are positioned at the A5-size position, the conductor 31 does not face the B5-size detection electrode portions 42 in the up-down direction. When the side guides 21, 22 are positioned at the A6-size position, the conductor 31 does not face the A5-size detection electrode portions 43 in the up-down direction. To meet the above requirements, settings are made to the dimensions in the left-right direction of the conductor 31 and the A6-size detection electrode portions 44 and the fixed value for the dimension of the difference between adjacent two of the A4-size detection electrode portion 41, the B5-size detection electrode portion 42, the A5-size detection electrode portion 43, and the A6-size detection electrode portion 44.

Sheet Size Detection

In response to the sheet cassette 12 installed at the installation position, the CPU 38 detects a size of a sheet S supported on the sheet cassette 12. The side guides 21, 22 are positioned in accordance with a size of a sheet S. The CPU 38 detects positions of the side guides 21, 22 from a signal outputted from the capacitance detector 34, thereby detecting a size of a sheet S from the positions of the side guides 21, 22.

Figure 4:
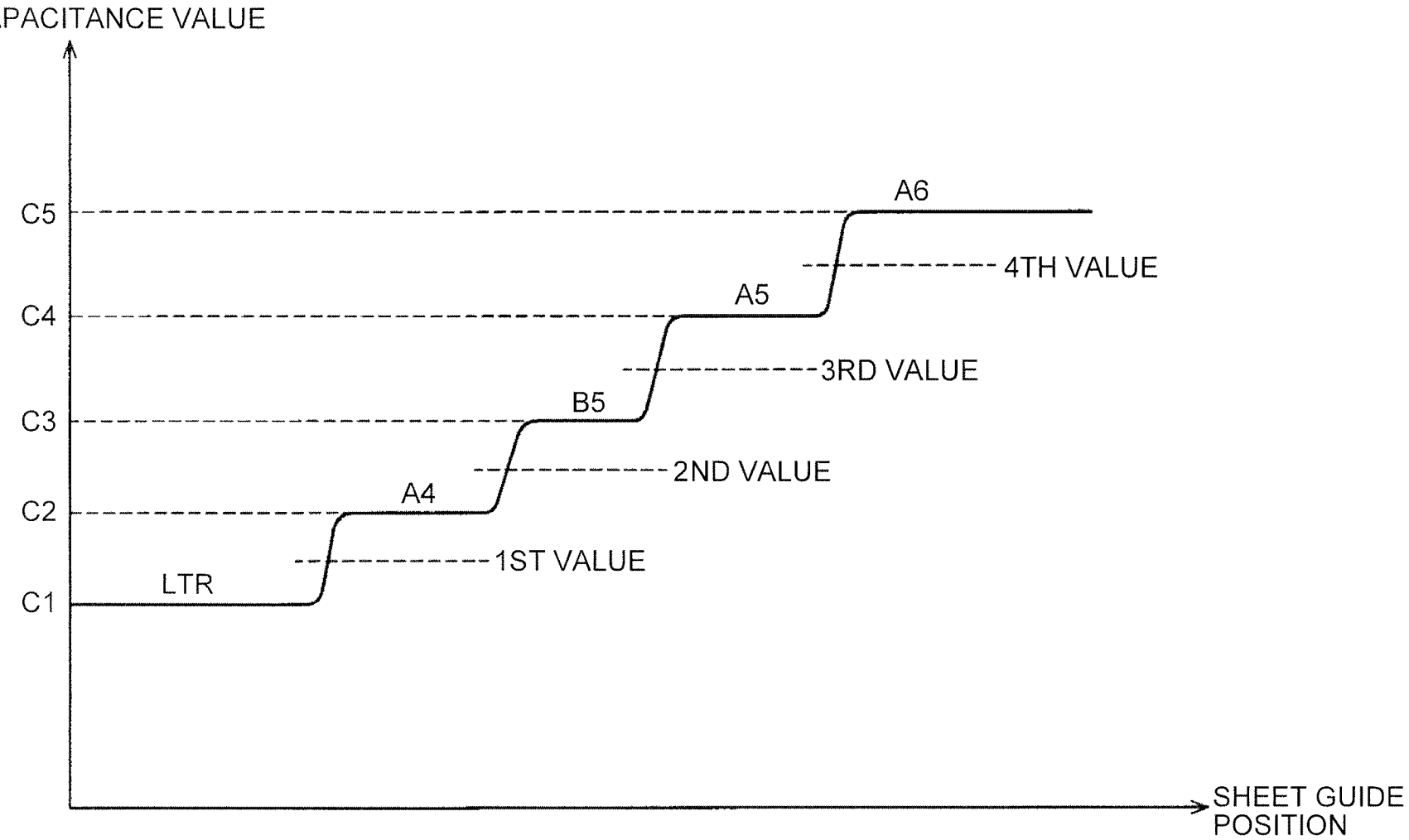
FIG. 4 is a graph illustrating changes in a capacitance value in relation to a position of a conductor on a side guide of the sheet cassette.

When the side guides 21, 22 are positioned at the letter-size position, the conductor 31 does not face any of the first electrode 32 and the second electrode 33 in the up-down direction. As the conductor 31, the first electrode 32, and the second electrode 33 do not form a pseudocapacitor, the capacitance value C detected from the signal outputted from the capacitance detector 34 becomes the minimum value C1 as illustrated in FIG. 4.

When the side guides 21, 22 are positioned at the A4-size position, the conductor 31 faces the whole areas of the A4-size detection electrode portions 41 of the first electrode 32 and the second electrode 33 in the up-down direction. The conductor 31 and the A4-size detection electrode portions 33 of the first electrode 32 and the second electrode 33 thus form a pseudocapacitor, and the capacitance value C detected from the signal outputted from the capacitance detector 34 becomes a value C2 that is greater than the minimum value C1 of when the side guides 21, 22 are positioned at the letter-size position.

When the side guides 21, 22 are positioned at the B5-size position, the conductor 31 faces the whole areas of the B5-size detection electrode portions 42 of the first electrode 32 and the second electrode 33 in the up-down direction. The conductor 31 and the B5-size detection electrode portions 42 of the first electrode 32 and the second electrode 33 thus form a pseudocapacitor. At that time, the conductor 31 does not face the A4-size detection electrode portions 41 in the up-down direction. As the dimension of the B5-size detection electrode portion 42 in the left-right direction is greater than that of the A4-size detection electrode portion 41 by the fixed value, an overlapping area between the conductor 31, the first electrode 32, and the second electrode 33 becomes enlarged by a fixed area. Thus, the capacitance value C detected from the signal outputted from the capacitance detector 34 becomes a value C3 that is greater than the value C2 of when the side guides 21, 22 are positioned at the A4-size position by a fixed value corresponding to the enlargement of the overlapping area.

When the side guides 21, 22 are positioned at the A5-size position, the conductor 31 faces the whole areas of the A5 size detection electrode portions 43 of the first electrode 32 and the second electrode 33 in the up-down direction. The conductor 31 and the A5-size detection electrode portions 43 of the first electrode 32 and the second electrode 33 thus form a pseudocapacitor. At that time, the conductor 31 does not face the B5-size detection electrode portions 42 in the up-down direction. As the dimension of the A5-size detection electrode portion 43 in the left-right direction is greater than that of the B5-size detection electrode portion 42 by the fixed value, the overlapping area between the conductor 31, the first electrode 32, and the second electrode 33 becomes enlarged by the fixed area. Thus, the capacitance value C detected from the signal outputted from the capacitance detector 34 becomes a value C4 that is greater than the value C3 of when the side guides 21, 22 are positioned at the B5-size position by a fixed value corresponding to the enlargement of the overlapping area.

When the side guides 21, 22 are positioned at the A6-size position, the conductor 31 faces the whole areas of the A6-size detection electrode portions 44 of the first electrode 32 and the second electrode 33 in the up-down direction. The conductor 31 and the A6-size detection electrode portions 44 of the first electrode 32 and the second electrode 33 thus form a pseudocapacitor. At that time, the conductor 31 does not face the A5-size detection electrode portions 43 in the up-down direction. As the dimension of the A6-size detection electrode portion 44 in the left-right direction is greater than that of the A5-size detection electrode portion 43 by the fixed value, the overlapping area between the conductor 31, the first electrode 32, and the second electrode 33 becomes enlarged by the fixed area. Thus, the capacitance value C detected from the signal outputted from the capacitance detector 34 becomes a value C5 that is greater than the value C4 of when the side guides 21, 22 are positioned at the A5-size position by a fixed value corresponding to the enlargement of the overlapping area.

The capacitance values C1, C2, C3, C4, C5 each of when the side guides 21, 22 are positioned at a position for one of letter-size, A4-size, B5-size, A5-size, and A6-size, are obtained, and a first value, a second value, a third value, and a fourth value are previously determined based on the capacitance values. Specifically, a median value between the capacitance values C1 and C2 is set to the first value, a median value between the capacitance values C2 and C3 is set to the second value, a median value between the capacitance values C3 and C4 is set to the third value, and a median value between the capacitance values C4 and C5 is set to the fourth value. The first value, the second value, third value, and the fourth value are stored in a nonvolatile memory 39 on the control board 35.

In response to the sheet cassette 12 installed at the installation position, the CPU 38 detects a capacitance value C from a signal outputted from the capacitance detector 34 and compares the capacitance value C with the first value, the second value, the third value, and the fourth value. In a case in which the CPU 38 determines that the capacitance value C is below the first value, the CPU 38 determines that the side guides 21, 22 is positioned at the letter-size position and a size of a sheet S stored in the sheet cassette 12 is letter size. In a case in which the CPU 38 determines that the capacitance value C is greater than the first value and below the second value, the CPU 38 determines that the side guides 21, 22 is positioned at the A4-size position and a size of a sheet S stored in the sheet cassette 12 is A4 size. In a case in which the CPU 38 determines that the capacitance value C is greater than the second value and below the third value, the CPU 38 determines that the side guides 21, 22 is positioned at the B5-size position and a size of a sheet S stored in the sheet cassette 12 is B5 size. In a case in which the CPU 38 determines that the capacitance value C is greater than the third value and below the fourth value, the CPU 38 determines that the side guides 21, 22 is positioned at the A5-size position and a size of a sheet S stored in the sheet cassette 12 is A5 size. In a case in which the CPU 38 determines that the capacitance value C is greater than or equal to the fourth value, the CPU 38 determines that the side guides 21, 22 is positioned at the A6-size position and a size of a sheet S stored in the sheet cassette 12 is A6 size.

Effects

As described above, the overlapping area between the conductor 31, the first electrode 32, and the second electrode 33 changes in response to the positions of the side guides 21, 22. Due to a change of the overlapping area, a signal outputted from the capacitance detector 34 changes, and thus the capacitance value C detected from the signal changes. The CPU 38 thus detects the positions of the side guides 21, 22 from the capacitance value C. The side guides 21, 22 are positioned in alignment with the left and right ends of sheets S supported on the sheet cassette 12. Thus, the CPU 38 detects the size of the sheets S in the sheet cassette 12 from the positions of the side guides 21, 22.

The sheet cassette 12 is devoid of a member movable in response to the movement of the side guides 21, 22. This may eliminate a factor leading to a failure of the side guides 21, 22 caused by damage to the movable member by user's handling.

Thus, the different sizes of sheets S to be supported on the sheet cassette 12 can be detected simply by using a single capacitive sensor including the first electrode 32, the second electrode 33, and the capacitance detector 34.

Thus, the size of sheets S to be supported on the sheet cassette 12 can be detected by an inexpensive and failure-resistant structure.

Each of the first electrode 32 and the second electrode 33 includes the A4-size detection electrode portion 41, the B5-size detection electrode portion 42, the A5-size detection electrode portion 43, and the A6 size-detection electrode portion 44. The A4-size detection electrode portion 41, the B5-size detection electrode portion 42, the A5-size detection electrode portion 43, and the A6-size detection electrode portion 44 are aligned in the moving direction or the left-right direction and connected to one another with the connection portions 45, 46, 47. This structure enables changing the overlapping area between the conductor 31, the first electrode 32, and the second electrode 33 in response to the positions of the side guides 21, 22, and thus enables changing the capacitance value C detected from the signal outputted from the capacitance detector 34. The CPU 38 thus detects a standardized size including the letter size, A4 size, A5 size, and A6 size accurately.

The connection portions 45, 46, 47 are rectangular and each have a dimension in the front-rear direction smaller than the dimension of the A4-size detection electrode portion 41 in the left-right direction. Thus, a capacitance value of a pseudocapacitor formed by the conductor 31 and the connection portions 45, 46, 47 is smaller than that of the pseudocapacitor formed by the conductor 31 and the A6-size detection electrode portions 41. As the capacitance value of the pseudocapacitor formed by the conductor 31 and the connection portions 45, 46, 47 has little effect on the detection of the positions of the side guides 21, 22, the CPU 38 thus detects the positions of the side guides 21, 22 accurately.

When the side guides 21, 22 are positioned at the B5-size position, the conductor 31 does not face the A4-size detection electrode portions 41 in the up-down direction. When the side guides 21, 22 are positioned at the A5-size position, the conductor 31 does not face the B5-size detection electrode portions 42 in the up-down direction. When the side guides 21, 22 are positioned at the A6-size position, the conductor 31 does not face the A5-size detection electrode portions 43 in the up-down direction. This structure enables differentiating between the capacitance values C, each detected from a signal outputted from the capacitance detector 34, by a fixed value in accordance with the positions of the side guides 21, 22.

When the side guides 21, 22 are positioned at the A6-size position, the conductor 31 faces the whole areas of the A6 size detection electrode portions 44 in the up-down direction. This obviates the need to increase the physical sizes of the conductor 31 and the A6-size detection electrode portions 44. This also enables maintaining of a difference between a capacitance value C of when the conductor 31 faces the A4-size detection electrode portion 41 having the minimum dimension in the left-right direction and a capacitance value C of when the conductor 31 does not face the first electrode 32 and the second electrode 33.

Modified Examples

The above embodiment illustrates a structure for detecting a standardized size of a sheet S. The first electrode 32 and the second electrode 33 may be modified as illustrated in FIGS. 5 and 6 for detecting any size other than the standardized sizes (within the dimension of the first electrode 32 and the second electrode 33 in the moving direction or the left-right direction).

Figure 5:
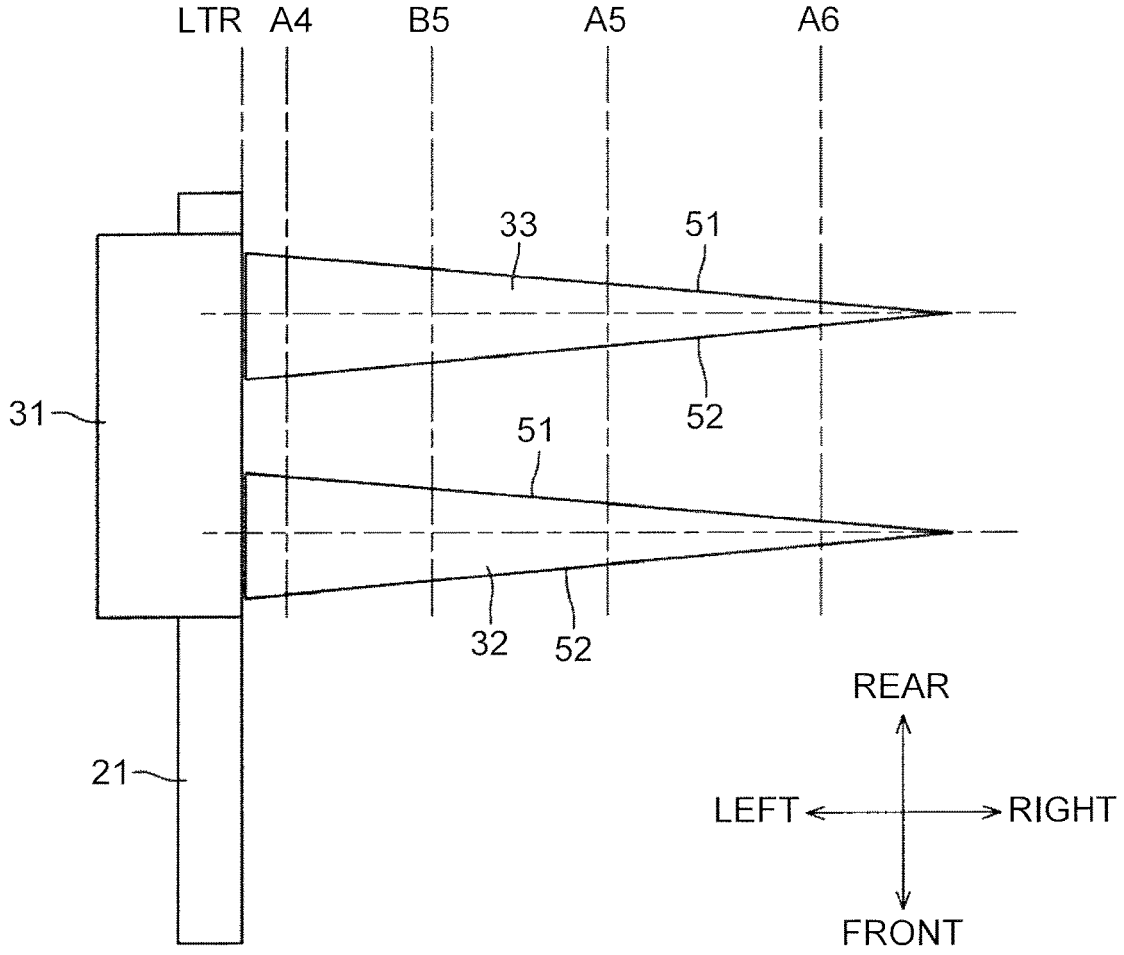
FIG. 5 is a plan view of a first electrode and a second electrode according to a modified example.
Figure 6:
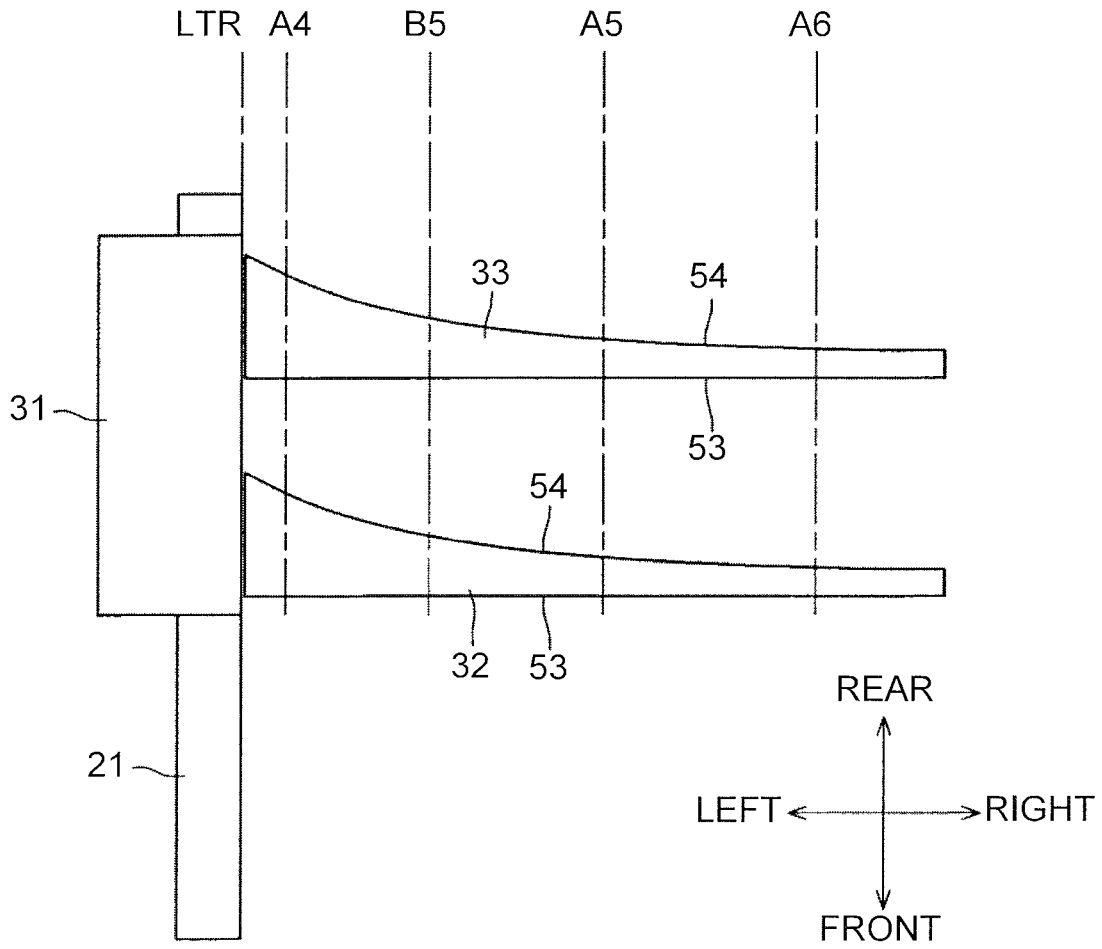
FIG. 6 is a plan view of a first electrode and a second electrode according to a modified example.

As illustrated in FIGS. 5 and 6, a first electrode 32 and a second electrode 33 are tapered from the letter-size position toward the A6-size position. In other words, each of the first electrode 32 and the second electrode 33 has a dimension in the front-rear direction decreasing toward the right. In an example illustrated in FIG. 5, the first electrode 32 and the second electrode 33 each have two sides 51, 52 crossing the front-rear direction and extending linearly. The sides 51, 52 are symmetrical relative to an imaginary line extending in the left-right direction. In the other example illustrated in FIG. 6, the first electrode 32 and the second electrode 33 each have two sides 53, 54 crossing the front-rear direction. The side 53 extends linearly in the left-right direction. The side 54 is curved toward the side 53.

Figure 7:
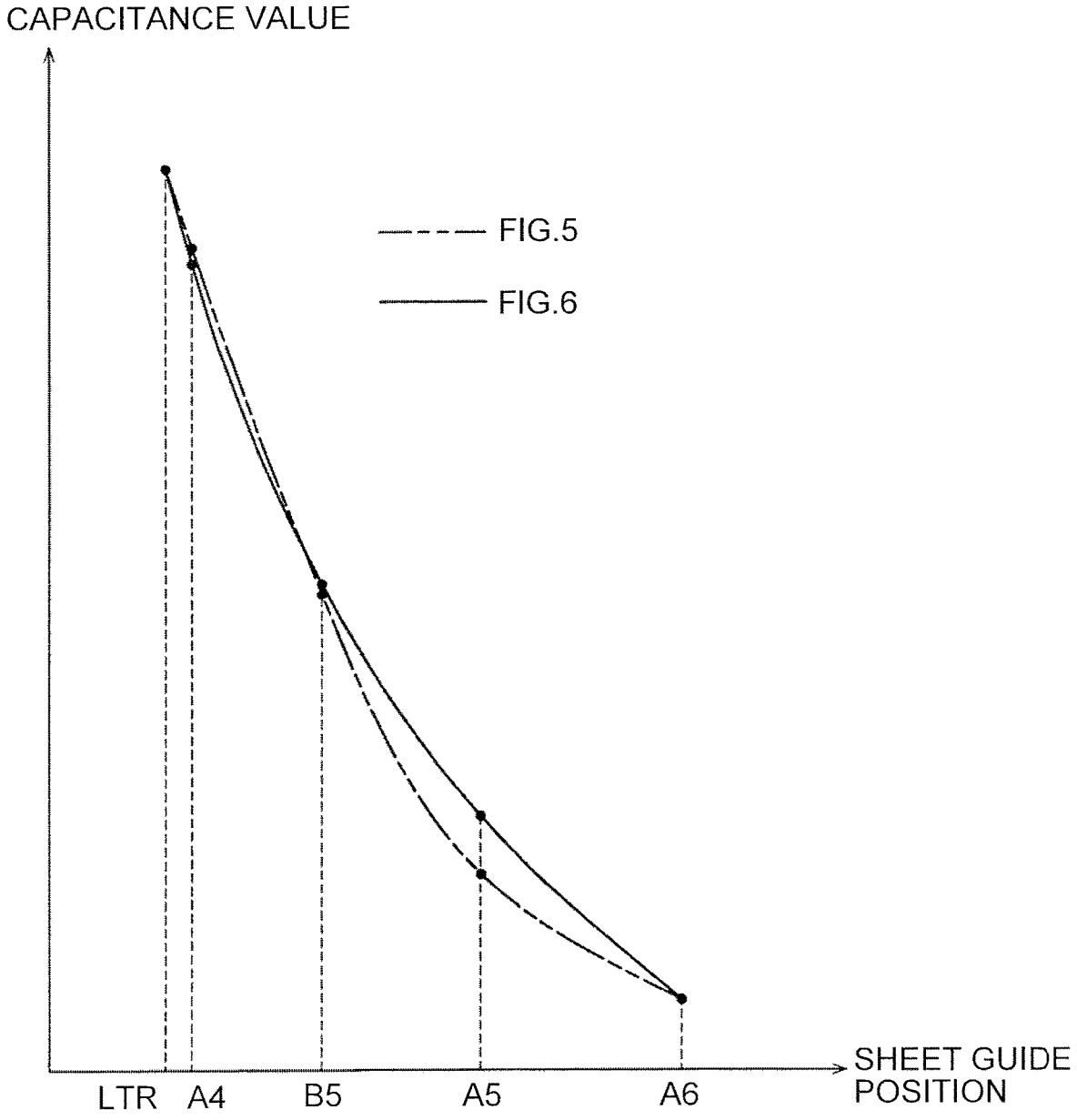
FIG. 7 is a graph illustrating changes in a capacitance value in relation to a position of a conductor in a structure including the first and second electrodes illustrated in FIGS. 5 and 6.

In both examples, an overlapping area between the conductor 31, the first electrode 32, and the second electrode 33 decreases as the side guides 21, 22 are positioned toward the innermost position (A6-size position). As illustrated in FIG. 7, as the side guides 21, 22 are positioned toward the innermost position (A6 size position), the capacitance value C detected from a signal outputted from the capacitance detector 34 becomes smaller. As to the first electrode 32 and the second electrode 33 shaped as illustrated in FIG. 5, as the side guides 21, 22 move toward the innermost side in the left-right direction or closer to each other in the left-right direction, an amount of change in the capacitance value C corresponding to an amount of their movement becomes smaller and thus a graph that represents a relationship between the positions of the side guides 21, 22 and the capacitance value C is close to a graph of a quadratic function (that is, a parabola). As to the first electrode 32 and the second electrode 33 shaped as illustrated in FIG. 6, as the side guides 21, 22 move toward the innermost side in the left-right direction or closer to each other in the left-right direction, the amount of change in the capacitance value C corresponding to the amount of their movement becomes smaller and thus a graph that represents a relationship between the positions of the side guides 21, 22 and the capacitance value C is close to a graph of a linear function (that is, a straight line). In other words, as to the first electrode 32 and the second electrode 33 shaped as illustrated in FIG. 6, as the side guides 21, 22 move toward the innermost side in the left-right direction or closer to each other in the left-right direction, the capacitance value C decreases substantially linearly.

As the capacitance value C detected from the signal outputted from the capacitance detector 34 varies according to the positions of the side guides 21, 22, the CPU 38 detects the positions of the side guides 21, 22 from the capacitance value C and thus a size of sheets S supported on the sheet cassette 12 from the detected positions of the side guides 21, 22.

As to the first electrode 32 and the second electrode 33 shaped as illustrated in FIG. 6, as the side guides 21, 22 move toward the innermost side in the left-right direction or closer to each other in the left-right direction, the capacitance value C decreases substantially linearly. Regardless of the positions of the side guides 21, 22, the capacitance value C greatly varies according to the movement of the side guides 21, 22. The CPU 38 thus detects a size of a sheet S more accurately compared with the first electrode 32 and the second electrode 33 shaped as illustrated in FIG. 5.

While the disclosure has been described in detail with reference to the specific embodiment thereof, aspects of the disclosure may be implemented in other embodiments.

The above embodiment and its modified examples illustrate that the conductor 31 is disposed on the side guide 21 and the first electrode 32 and the second electrode 33 are disposed such that the overlapping area between the conductor 31, the first electrode 32, and the second electrode 33 varies according to the movement of the side guides 21, 22. Alternatively, for example, one conductor 31 may be disposed on each of the side guides 21, 22 and a set of the first electrode 32 and the second electrode 33 may be disposed at two positions in the left-right direction. In that case, connections between the left and right first electrodes 32 and between the left and right second electrodes 33 may enable detection with an increased difference between outputted signals, thus obviating the need to increase the number of capacitance detectors 34. The rear-end guide 23 (as an example of a sheet guide) may include a conductor and a first electrode and a second electrode may be disposed such that an overlapping area between the conductor, the first electrode, and the second electrode varies according to the movement of the rear-end guide 23. The overlapping area may vary in response to the position of the rear-end guide 23 and the capacitance value C of a synthetic pseudocapacitor may vary. In the synthetic pseudocapacitor, a pseudocapacitor formed by the conductor and the first electrode and a pseudocapacitor formed by the conductor and the second electrode may be connected in series. The CPU 38 detects the position of the rear-end guide 23 from the capacitance value C and thus a size of sheets S supported on the sheet cassette 12 from the detected position of the rear-end guide 23.

While the disclosure has been described in detail with reference to the specific embodiment thereof, various changes, arrangements and modifications may be applied therein without departing from the spirit and scope of the disclosure.

What is claimed is:

1. An image forming apparatus comprising:

a main body including:

a first electrode;

a second electrode; and a capacitance detector configured to output a signal indicating a value corresponding to a quantity of electricity stored in the first electrode and the second electrode;

an image forming unit disposed in the main body;

a sheet cassette attachable to the main body and configured to support a sheet to be supplied to the image forming unit, the sheet cassette including:

a sheet guide movable to position the sheet relative to the sheet cassette, and a conductor disposed in an upper portion of the sheet guide; and a controller disposed in the main body, wherein the main body defines an installation position in which sheets are feedable from the sheet cassette toward the image forming unit, wherein the first electrode and the second electrode are disposed such that, in a state in which the sheet cassette is at the installation position defined in the main body, the first electrode and the second electrode face the conductor in an up-down direction and are at different positions in a moving direction in which the sheet cassette is inserted, the moving direction being orthogonal to the up-down direction, and wherein the controller is configured to detect a position of the sheet guide from the value of the signal outputted from the capacitance detector.

2. The image forming apparatus according to claim 1, wherein the first electrode and the second electrode are disposed such that, in a state in which the sheet cassette is at the installation position, the first electrode and the second electrode overlap the conductor in the up-down direction.

3. The image forming apparatus according to claim 1, wherein the first electrode and the second electrode each include a plurality of size detection electrode portions, the size detection electrode portions each having a different length in a positioning direction in which the sheet guide is movable to position the sheet relative to the sheet cassette, the size detection electrode portions being aligned in the positioning direction and connected to one another with connection portions.

4. The image forming apparatus according to claim 3, wherein dimensions of each of the size detection electrode portions are the same in a direction orthogonal to the up-down direction and the positioning direction, and wherein each of the size detection electrodes have respective different dimensions in the positioning direction, the respective different dimensions being different from one another by a fixed value.

5. The image forming apparatus according to claim 3, wherein the connection portions each have a dimension in a direction orthogonal to the up-down direction and the positioning direction, such that a value of a signal outputted from the capacitance detector of when the conductor faces each of the connection portions is smaller than a value of a signal outputted from the capacitance detector when the conductor faces a size detection electrode portion having a minimum dimension in the positioning direction, of the size detection electrode portions.

6. The image forming apparatus according to claim 3, wherein the size detection electrode portions include a maximum size detection electrode portion having a maximum dimension in the positioning direction, wherein the conductor has a dimension in the positioning direction equal to the maximum dimension of the maximum size detection electrode portion, and wherein, in a state in which the conductor faces a whole area of one of the size detection electrode portions in the up-down direction, the conductor does not face another one of the size detection electrode portions in the up-down direction.

7. The image forming apparatus according to claim 1, wherein each of the first electrode and the second electrode has a first end and a second end opposite to the first end in a positioning direction in which the sheet guide is movable to position the sheet relative to the sheet cassette, and wherein each of the first electrode and the second electrode is tapered from the first end to the second end.

8. The image forming apparatus according to claim 1, wherein the first electrode and the second electrode are identical in shape.

9. The image forming apparatus according to claim 1, wherein the first electrode and the second electrode each disposed at a position that is the same in a positioning direction in which the sheet guide is movable to position the sheet relative to the sheet cassette.

10. The image forming apparatus according to claim 1, wherein the conductor has a dimension in a particular direction orthogonal to the up-down direction and a positioning direction in which the sheet guide is movable to position the sheet relative to the sheet cassette, equal to a total dimension, in the particular direction, including at least dimensions of the first electrode and the second electrode in the particular direction and a dimension between the first electrode and the second electrode in the particular direction.

11. The image forming apparatus according to claim 7, wherein the first electrode and the second electrode each have two sides between the first end and the second end, and wherein each of the two sides extend linearly.

12. The image forming apparatus according to claim 7, wherein the first electrode and the second electrode each have two sides between the first end and the second end, and wherein a first one of the two sides extends linearly and a second one of the two sides curves toward the first one of the two sides.

13. The image forming apparatus according to claim 12, wherein the first electrode and the second electrode are shaped such that the value of the signal outputted from the capacitance detector changes linearly in the positioning direction.

* * * * *